United States Patent [19]

Chapman

[11] Patent Number: 4,837,933

[45] Date of Patent: Jun. 13, 1989

[54] MACHINE FOR REMOVING TILES AND LIKE COVERING MATERIAL FROM ROOF SURFACES

[76] Inventor: Ward W. Chapman, 2700 W. Third Ct., Hialeah, Fla. 33010

[21] Appl. No.: 147,280

[22] Filed: Jan. 22, 1988

[51] Int. Cl.[4] ..... E04D 15/00

[52] U.S. Cl. ..... 30/120; 299/37

[58] Field of Search ..... 30/169, 170; 15/93 R; 299/37

[56] References Cited

U.S. PATENT DOCUMENTS

| | | | |
|---|---|---|---|
| 2,519,138 | 8/1950 | Katz | 299/37 |
| 3,074,090 | 1/1963 | Thompson | 299/37 X |
| 3,779,605 | 12/1973 | Nieman | 299/37 |
| 4,277,104 | 7/1981 | Sanchez | 299/37 |
| 4,709,479 | 12/1987 | Lavelette | 30/170 |

*Primary Examiner*—Frank T. Yost
*Assistant Examiner*—Michael D. Folkerts
*Attorney, Agent, or Firm*—Charles J. Prescott

[57] ABSTRACT

A machine for effectively and efficiently removing tiles as well as other covering material from the exterior of roof surfaces such as when the roof is to be repaired or such covering material is to be replaced. The machine travels over the roof surface and includes a separating structure reciprocally positionable between a forwardly directed separating engagement with the covering material and a lifting position relative thereto as the material is physically separated from the surface of the roof. In operation the machine may travel, under an operators control, continuously back and forth along the length of the roof until all the covering material has been removed therefrom.

8 Claims, 2 Drawing Sheets

10
12
14
16
18
20
21
22
24
26
28
30
32
34
36
38
40
42
44
46
47
48
50
52
52'
53
55
57
58'
59
63
66
72
72'
75
76
3

MACHINE FOR REMOVING TILES AND LIKE COVERING MATERIAL FROM ROOF SURFACES

BACKGROUND OF THE INVENTON

1. Field of the Invention

This invention relates to a machine structured to travel continuously along the length of a roof's surface and including a separating member or structure pivotally mounted thereon and capable of imparting a lifting and separating action, concurrently to the covering material and more particularly the under surface thereof so as to separate it from the exterior surface of the roof from which it is being removed.

2. Description of the Prior Art

In the roofing industry, a large part of the business is dedicated to the repair and replacement of all or portions of the covering material initially or originally secured to the exterior surface thereof. Obviously, such covering material can take many forms and includes tile pieces as well as elongated strips of generally waterproof material, disposed in overlapping relation to one another so as to prevent water and moisture from seeping through and beyond the covering material. Frequently, numerous layers of tar or like sealing material are first placed on the roof surface between the exterior covering material such as the tiles, etc. so as to again insure a moisture seal barrier and prevent leakage or passing of the environmental elements, snow, rain, etc. from passing into the interior of the building through and beyond the covering material.

However, one problem generally recognized in the industry and directly associated with the repair of a roof structure includes the rather laborious and time-consuming and certainly disagreeable process of removing the old or original covering material from the roof's surface in order to apply new material thereto.

In the past the prior art has relied primarily on manual techniques for removing such covering material. Such techiques have been rather primitive relying primarily on the use of manual tools such as scrapers, cutters and like hand operated implements for the physical and laborious task of removing such covering material. Currently, there are no "automatic" or time-consuming machines in use which are recognized as being efficient and effective removal of tiles or other covering material from the exterior surface of the roof in a manner which will eliminate the use of the manual method as generally set forth above.

Therefore, it is obvious that there is a recognized need in the roofing industry for a device, apparatus or machine capable of effectively, rapidly and efficiently removing covering material from a roof surface, regardless of its structure, so that the original exposed surface of the roof can be repaired and/or recovered in order to prevent leakage and insure that harsh environmental elements do not enter the building or otherwise damage the structural integrity of the building by causing rot of facilitating other deteriorating factors.

SUMMARY OF THE INVENTION

The present invention is directed to a machine or like automatic device for the effective and rapid removal of roof tiles or other similar covering material from the exterior surface of a roof for purposes of replacement of such cover material or the overall repair of the roof itself. More specifically the subject machine includes a frame which is movable across the roof surface, preferably manually. To facilitate such travel, the frame is supported on the roof surface by a plurality of wheels, rollers, etc. Further, the frame is structured and disposed to support the other operative components of the machine in a manner to be described in greater detail hereinafter. A separating means is pivotally secured to the frame and disposed at a leading, frontal portion thereof as the machine travels along the length of the roof. The separating means includes a lifting member, preferably in the form of a blade element which performs both separating, cutting and lifting function or action to the under surface of the cover material being removed and the exterior or exposed surface of the roof itself. For purposes of clarity and explanation, references hereinafter to the exterior surface of the roof. This is intended to include the exposed surface of a sealing layer of tar or other material which may be applied to the actual, physical exterior surface of the roof and to which the original covering material was initially bonded or secured.

Therefore, an important feature of the present invention is the imparting of a concurrent motion to the separating means generally and more particularly to the lifting member defined by the aforementioned blade structure. The concurrent, operative motion of the lifting member is defined by a forward separating engagement of the blade with the under surface of the covering material for purposes of physically separating the covering material at its point of engagement or securement from the roof surface or any sealing barrier disposed thereon. At the same time, the lifting member or blade has imparted thereto a lifting motion such that the lifting member is reciprocally forced into a lifting or raised position as it travels forwardly. This in turn imparts a lifting action to the covering material forcing its separation from the roof surface or sealing or barrier material for which it was originally attached.

The machine of the present invention further includes a drive means driven by a drive motor wherein the drive motor and drive means are mounted on the frame and travel therewith as the frame travels forwardly along the length of roof and separates the original covering material from the roof surface. The drive means is specifically structured to include an eccentrically configured cam which periodically or reciprocally engages a portion of the separating means causing its reciprocal and pivotal movement relative to the frame and thereby imparting the aforementioned periodic lifting motion to the under surface of the covering material as the frame moves concurrently forward along the roof causing a lifting and separation of the covering material from the roof surface.

Further structural features of the subject machine include the provision of a transfer means mounted adjacent to the separating means but in generally overlying relation thereto. A leading end of the transfer means is disposed substantially adjacent to the lifting member and in direct receiving relation to the covering material once it is separated or removed from the roof's surface. The disposition of the transfer means is such as to substantially overly the separating means in a fixed attachment to the frame. Accordingly, the transfer means has sufficient length to effectively transfer or "carry" the covering material, once removed, from its original location on the roof's surface, by lifting and separating engagement with the blade or lifting member of the separating means.

Further and additional structural features of the present invention will be described in greater detail hereinafter.

DETAILED DESCRIPTION OF THE PREFERRED EMBODIMENT

Figures 1, 2:
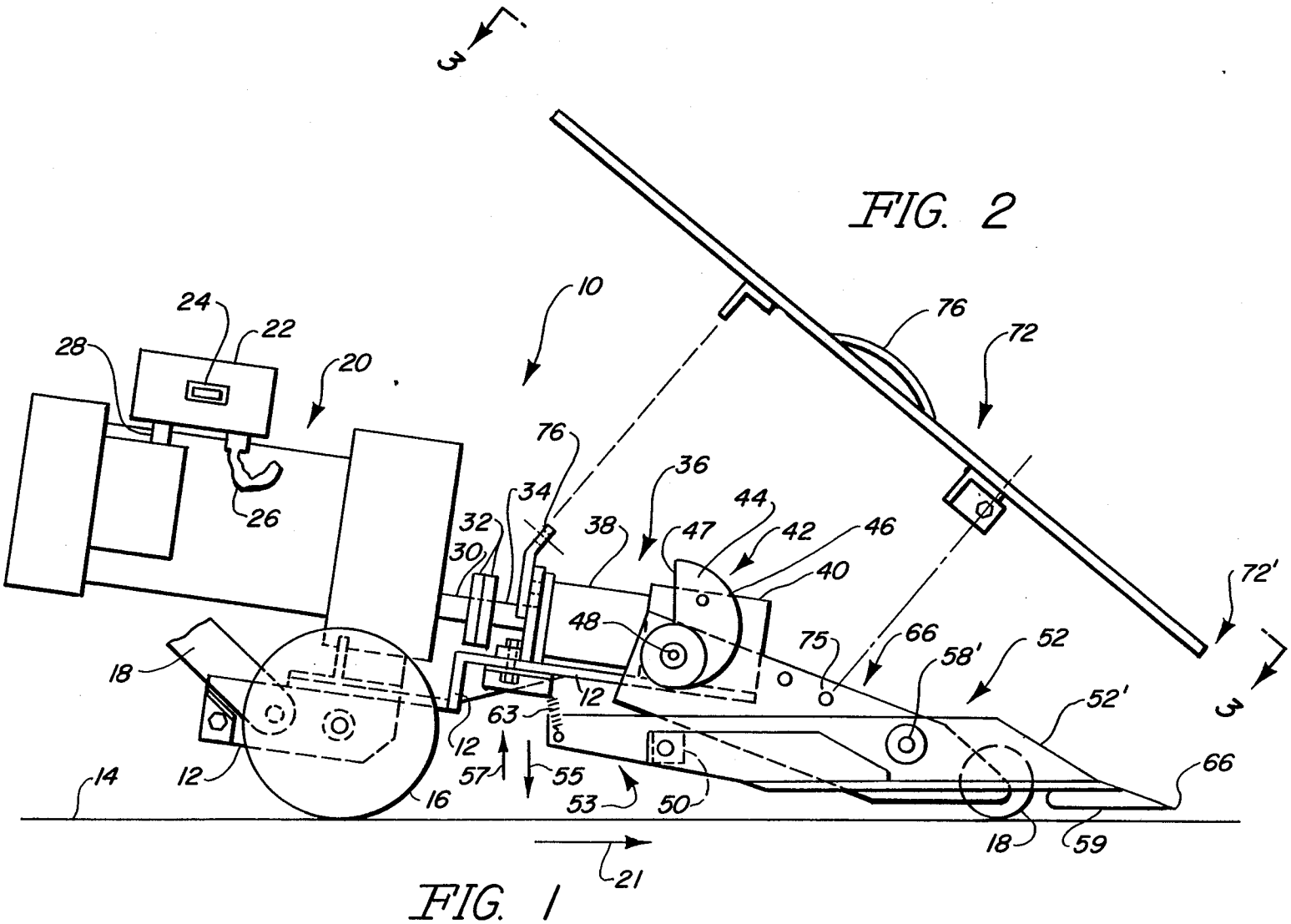
FIG. 1 is a side view of the machine of the present invention shown mounted on a roof or other supporting surface in its operative position.
FIG. 2 is a side view of a transfer structure associated with the machine.

As shown in FIG. 1, the machine of the present invention is generally indicated as 10 and includes a frame means 12 used to support various other components of the machine as will be explained in greater detail hereinafter. The frame 12 is supported on a roof surface schematically represented as 14 by a plurality of wheels 16 and 17 affixed to various portions of the frame clearly shown in FIG. 1. The machine as represented in FIG. 10 may be manually pushed along the length of the roof by an outwardly extending handle shown in partial detail and represented at 18 in FIG. 1. Obviously, it should be apparent that the handle may take a variety of forms and is dependent generally on the overall size and design of the machine. Suffice it to say that the handle 18 extends generally rearwardly of the intended forward direction of travel as indicated by the directional arrow 20.

The machine 10 includes a drive motor generally indicated as 20 controlled by a switching assembly represented by the exterior housing 22 wherein an on/off activating switch 24 is represented thereon. A proper electrical conductor structure as at 26 and 28 serves respectively to direct power from a conventional source to the switching assembly 22 and from there directly to the working components to the drive motor 22. A power take-off of the drive motor is shown by take-off shaft 30 fixedly connected in driving relation by a connecting member 32 which serves to interconnect the power take-off shaft 30 to an input or drive shaft 34 of the drive means which is generally represented as 36.

The drive means 36 includes an exterior housing as at 38 and 40 respectively disposed to include the protection and housing of gearing members and the like. In operation the drive motor 20 imparts a rotary output driving motion through output shaft 30. The shaft interconnection as at 32 imparts the same rotary motion to the intake shaft 34 of the drive means 36. Proper gearing located both in the housing segments 38 and 40 in turn imparts a rotary motion to a cam means generally indicated as 42. The cam means includes at least one but preferably two cam members (only one shown for purposes of clarity ) as at 44. Each of the cam members 44 curved generally eccentrically configured peripheral surfaces as at 46. Further, each of the cam members 44 are driven about an axis of rotation as at 48 defined by a mounting stub axle transversely located to the length of the input shaft 34 serving to drive the interior gearing within the housing segments 38 and 40. The transverse placement relative to the length of the housing segments 38 and 40 serves to allow periodic and successive engagement of the exterior driving peripheral surface 46 of cam member 44 with a cam seat member or structure 50 shown in both FIGS. 1 and 4. The seat member 50 is attached directly to the separating means which is generally indicated as at 52.

As set forth above, in that each of the cam members 44 are eccentrically mounted as at one end at 48 and have their peripheries eccentrically configured as at curved portion 46 and straight portion 47, it should be apparent that engagement of the curved peripheral portion 46 of cam member 44 with seat 50 will cause a reciprocal pivotal movement or travel of the separating means 52 about supporting shaft 58. Also, the separating means 52 including both arms 60 are connected to the supporting shaft 58 so as to be pivotal thereto. Therefore, as the cam members 44 rotate continuously about the rotational axis 48 the curved periphery 46 will periodically come into driving engagement with the cam seats 50 thereon. This engegement will force the trailing end 53 of separation means 52 downwardly in accordance with directional arrow 55. However, when the curved periphery 46 of each of the cams 44 disengages from the cam seat 50 during the continuous rotation of the cam members 44, a biasing means in the form of biasing spring 63 will force the trailing end 53 of the separation means 52 upwardly in accordance with the directional arrow 57 of FIG. 1 thereby imparting to the separating means 52 a continuous reciprocal, pivotal motion about the shaft 58 and the pivotal axis 58′ as shown in FIG. 1.

Figure 4:
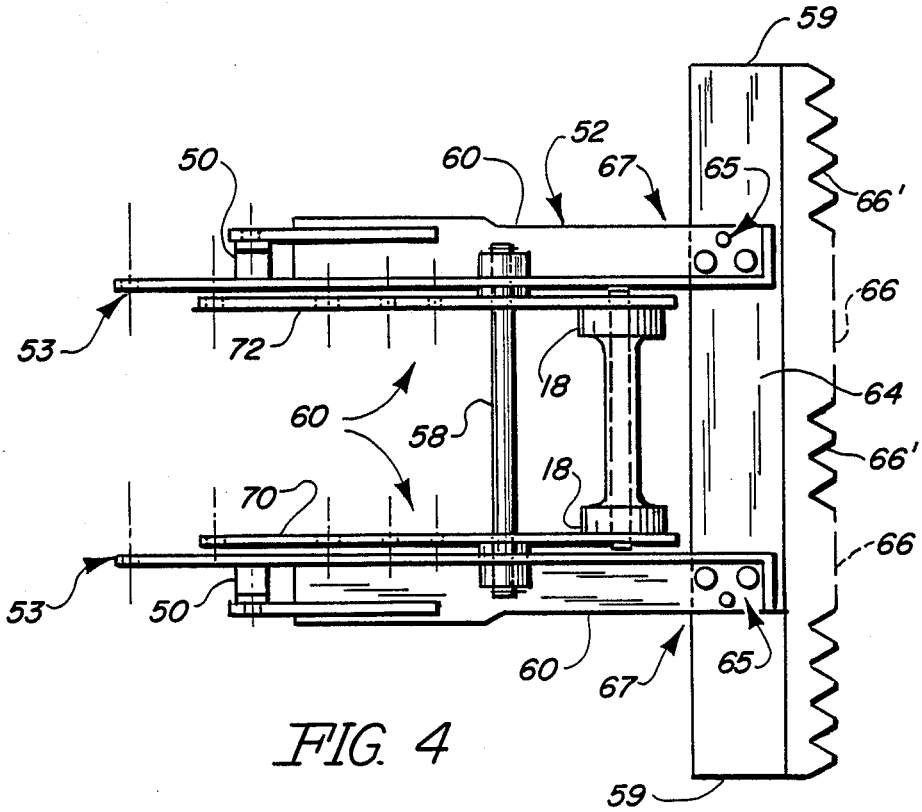
FIG. 4 is a top plan detail view of the separating means and portion or the supporting frame attached thereto.

The separating means 52 also includes a lifting member 59 which is generally in the form of a blade 64. The blade 64 has a leading peripheral cutting or separating edge as at 66 which actually comes into contact and establishes a cutting or separating engagement with the under portion of the covering material or roof tiles and its point of connection or securement to the exterior surface of the roof 14. As shown in FIG. 4, the actual configuration of the cutting peripheral edge 66 may vary from a straight line configuration to a serrated configuration as at 66′. The lifting member or blade 64 may be fixedly connected by appropriate connectors 65 to the leading end or portion of the separating means 52 generally as at 67. Therefore, it should be apparent that both a concurrently applied forward and separating lifting motion is imparted to the lifting member 59 due to the forward direction of travel of the machine 10 and the reciprocal motion of the separating means 52 to define an operative motion of the lifting member.

Another feature of the present invention is the existence of a mounting structure 69 defining a portion of the frame 12 and disposed in a frontal leading portion theeof. The mounting structure 69 is oriented in a somewhat downward angular orientation as clearly shown in FIG. 1 in order to properly place the separating means 52 and more particularly the lifting member 59 and cutting edge 66 thereof in proper separating engagement between the under surface of the covering material and the roof surface 14. The mounting structure includes two spaced apart arms 70 and 72 and a supporting wheel or roller structure 17. The connecting shaft 58 is disposed between arms 70 and 72 and serves as a pivotal axis for the separating means 52 as set forth above. The concurrent lifting motion of the separating means 52 and forward motion of the machine 10 as it is forced to travel forwardly along the roof surface 14 in accordance with the directional arrow 21 will cause the cover material, once removed from the roof surface 14, to transfer up onto a transfer means generally indicated as 72. the transfer means is fixedly disposed to the frame substantially at the location 75 on the mounting structure 66 and 76 on the frame itself adjacent to the drive means 36.

Figure 3:
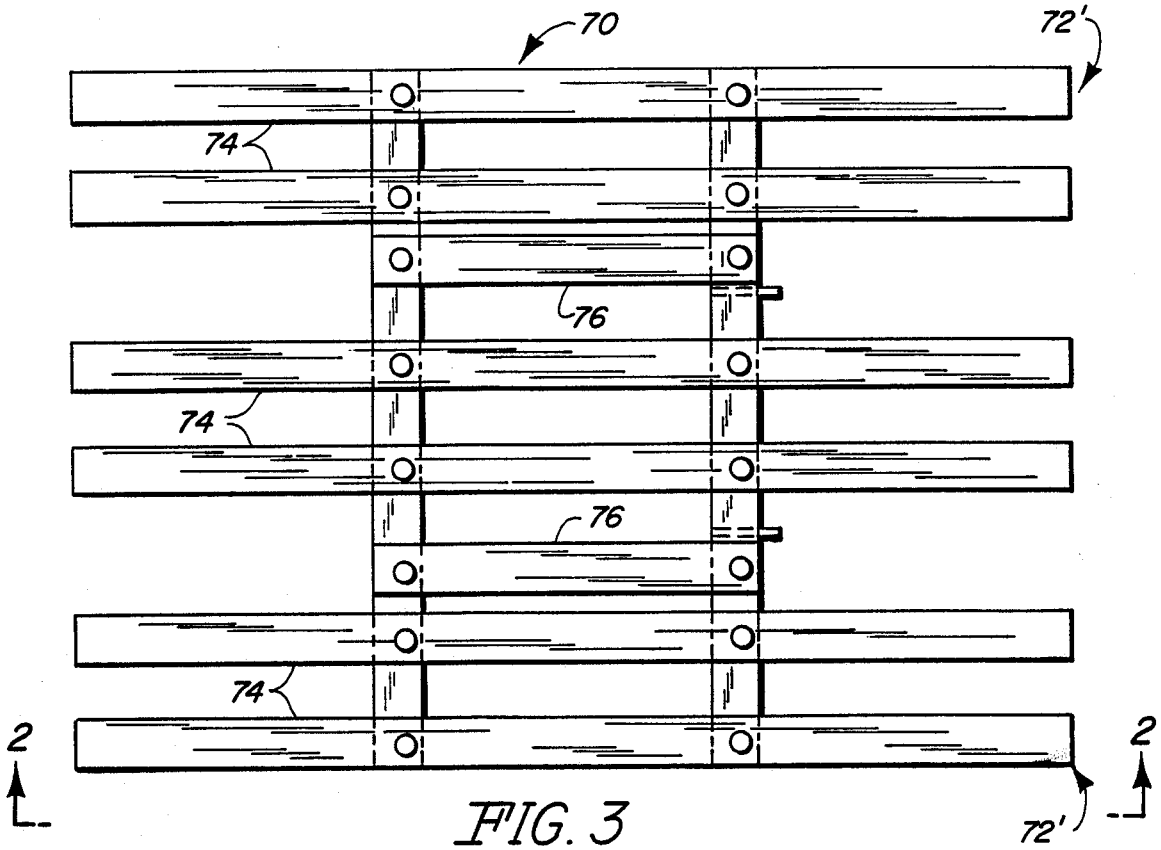
FIG. 3 is a top plan view of the transfer structure shown in FIG. 2.

With reference to FIG. 3, the transfer means 70 includes a plurality of tines 74 disposed in spaced apart relation to one another as well as at least two handles 76 also disposed in spaced apart relation from one another and from the tine 74. The spacing between the tines 74 is dimensioned so as to allow non-interfering passage of the cam members 44 as they continuously rotate upon activation of the drive means 36. Further, the leading end 72' of the transfer means 72 is disposed immediately adjacent to and contiguous the lifting member 59. In this leading position and also in part due to the angular orientation of the transfer means 72, the cover mateerial, once removed from the roof's surface 14, will pass upwardly onto the outer exposed surface of the tines 74 and thereby be "carried" away from the point of separating engagement of the blade 64 and at such point it was connected to the roof's surface 14.

Now that the invention has been described,

What is claimed is:

1. A machine for removing roof tiles or like covering material from the exterior surface of a roof, said machine comprising:

a. a frame means for supporting operable components of the machine and structured to travel over the exterior roof surface in a forward direction, b. separating means pivotally mounted on said frame means and comprising a lifting member disposed in a leading disposition and in engaging relation to the covering material for separation thereof from the exterior roof surface, c. drive means mounted on said frame means and disposed in driving, engageable relation with said separating means for imparting a pivotal, material separating motion to said separating means, d. said frame means comprising a mounting structure fixedly disposed on a leading portion of said frame means, said separating means pivotally connected to said mounting structure at a location between said lifting member and a trailing portion of said separating means, e. said lifting member reciprocally disposed between a separating engagement with the cover material and a raised position disposed in lifting engagement with the removed cover material relative to an under surface thereof, f. a biasing means interconnected between said trailing portion and said frame means and structured for normally biasing said lifting member out of said raised position and into said separating engagement with the removed covering material, g. a drive motor mounted on said frame means and movable therewith over the exterior roof surface, said drive motor drivingly connected to said drive means for activation thereof, and h. said lifting member movable in an operative motion defined by forward movement of said frame means and concurrent, reciprocal lifting motion of said lifting member, upon activation of said drive means, relative to the covering material being removed from the exterior surface of the roof.

2. A machine as in claim 1 further comprising transfer means mounted on said frame means adjacent said separating means and in receiving relation to the covering material being removed from the roof.

3. A machine as in claim 2 wherein said transfer means comprises a leading edge portion disposed immediately adjacent said lifting member and in receiving relation to the removed cover material.

4. A machine as in claim 3 wherein said transfer means is disposed in overlying relation to said separating means and a frontal portion of said frame means and including a sufficient length to transfer the removed covering material substantially away from a local of engagement with said lifting member.

5. An assembly as in claim 4 wherein said taransfer means comprises a plurality of spaced apart tynes, at least some of said tynes extending the length of said transfer means in overlying relation to said separating means and including corresponding ends thereof collectively defining said leading edge portion of said transfer means.

6. A machine as in claim 1 wherein said lifting member comprises an elongated blade structure disposed in transverse relation to the forward direction of travel of said frame and including a cutting edge extending along a leading longitudinal periphery of said cutting blade.

7. A machine as in claim 6 wherein said cutting edge is disposed in separating engagement between an under surface of the covering material being removed and the exterior roof surface.

8. A machine as in claim 1 wherein said drive means comprises at least one cam member rotatably mounted on said frame means and including an eccentrically configured engaging surface disposed in periodic driving engagement with said trailing portion and dimensioned to force pivotal movement of said separating means relative to said mounting member and reciprocal disposition of said lifting member between said separating engagement and said raised position.

* * * * *